US005916722A

United States Patent [19]

Creatura et al.

[11] Patent Number: 5,916,722

[45] Date of Patent: Jun. 29, 1999

[54] TONER COMPOSITIONS

[75] Inventors: John A. Creatura, Ontario; Scott M. Silence, Fairport, both of N.Y.

[73] Assignee: Xerox Corporation, Stamford, Conn.

[21] Appl. No.: 09/019,527

[22] Filed: Feb. 5, 1998

[51] Int. Cl.[6] ..... G03G 9/097

[52] U.S. Cl. ..... 430/110; 430/137

[58] Field of Search ..... 430/110, 137

[56] References Cited

U.S. PATENT DOCUMENTS

| | | | |
|---|---|---|---|
| 3,590,000 | 6/1971 | Palermiti et al. | 430/110 |
| 3,893,935 | 7/1975 | Jadwin et al. | 430/110 |
| 3,900,588 | 8/1975 | Fisher | 430/110 |
| 4,053,462 | 10/1977 | Beffa et al. . | |
| 4,079,014 | 3/1978 | Burness et al. | 430/110 |
| 4,111,974 | 9/1978 | Mazour et al. . | |
| 4,206,064 | 6/1980 | Kiuchi et al. | 430/106 |
| 4,298,672 | 11/1981 | Lus | 430/108 |
| 4,314,937 | 2/1982 | Beffa . | |
| 4,338,390 | 7/1982 | Lu | 430/106 |
| 4,394,430 | 7/1983 | Jadwin et al. | 430/110 |
| 4,404,271 | 9/1983 | Kawagishi et al. | 430/110 |
| 4,433,040 | 2/1984 | Niimura et al. | 430/109 |
| 4,560,635 | 12/1985 | Hoffend et al. | 430/106.6 |
| 4,647,522 | 3/1987 | Lu | 430/110 |
| 4,659,641 | 4/1987 | Mahalak et al. | 430/109 |
| 4,795,689 | 1/1989 | Matsubara et al. | 430/99 |
| 4,917,982 | 4/1990 | Tomono et al. | 430/99 |
| 4,921,771 | 5/1990 | Tomono et al. | 430/110 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,376,494 | 12/1994 | Mahabadi et al. | 430/137 |
| 5,643,708 | 7/1997 | Lin | 430/137 |

*Primary Examiner*—Roland Martin
*Attorney, Agent, or Firm*—E. O. Palazzo

[57] ABSTRACT

A toner composition comprised of a mixture of first toner with wax, and second toner free of wax, and wherein said first and said second toner contain binder, and said first toner with wax contains colorant.

25 Claims, No Drawings

TONER COMPOSITIONS

BACKGROUND OF THE INVENTION

The present invention is generally directed to toner and developer compositions, and more specifically, the present invention is directed to negatively, or positively charged toner compositions, or toner particles containing wax additives. More specifically the present invention relates to toners and processes thereof, and which toners are generated from a mixture of toner containing no wax, and a toner with wax, and which toners possess a number of advantages, such as minimization, or elimination of toner flow reduction, or fall off, improved toner transfer, acceptable developed toner mass, reduction in the amount of wax that escapes, and providing images with excellent resolution, and reduced backgrounds after extended imaging cycles, for example after about 500,000 imaging cycles. The aforementioned toner compositions can contain colorants of for example, carbon black, magnetite's, or mixtures thereof, cyan, magenta, yellow, blue, green, red, or brown components, or mixtures thereof, and preferably carbon black, thereby providing for the development and generation of black and/or colored images, and in embodiments single component development wherein a carrier or carrier particles are avoided. The toner and developer compositions of the present invention can be selected for electrophotographic, especially xerographic, imaging and printing processes, including color and digital processes.

PRIOR ART

Toner compositions with waxes, such as low molecular weight waxes are known, and such toners are illustrated in for example, U.S. Pat. Nos. 5,023,158, 5,004,666, 4,997,739, 4,988,598, 4,921,771, 4,917,982, and 4,795,689, the disclosures of each of these patents being totally incorporated herein by reference in their entireties. Also, toner compositions with certain surface additives, including certain silicas, are known. Examples of these additives include colloidal silicas, such as certain AEROSILS like R972® available from Degussa, metal salts and metal salts of fatty acids inclusive of zinc stearate, aluminum oxides, cerium oxides, and mixtures thereof, which additives are generally present in an amount of from about 1 percent by weight to about 5 percent by weight, and preferably in an amount of from about 1 percent by weight to about 3 percent by weight. Several of the aforementioned additives are illustrated in U.S. Pat. Nos. 3,590,000 and 3,900,588, the disclosures of which are totally incorporated herein by reference. The waxes and additives of the aforementioned prior art may be selected as components for the toners of the present invention in embodiments thereof.

Toner compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions. There are also described in U.S. Pat. No. 2,986,521 reversal developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive. The disclosures of each of these patents is totally incorporated herein by reference.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Toners with reactive extruded polyesters are illustrated for example, in U.S. Pat. No. 5,376,494, the disclosure of which is totally incorporated herein by reference. The resins, especially the polyester resins of this patent are suitable as toner resin for the present invention.

The appropriate components of the above patents may be selected for the toners and developers of the present invention in embodiments thereof.

SUMMARY OF THE INVENTION

Examples of features of the present invention in embodiments thereof include:

It is an feature of the present invention to provide toner compositions generated from a mixture of toner with wax and a toner with an absence of, or no wax.

Another feature of the present invention relates to toners wherein excessive frictional characteristics thereof are reduced, or minimized, especially with reactive extruded polyester toners, and wherein image transfer is excellent for extended imaging cycles, for example up to about 1,000,000 imaging cycles it is believed.

In another feature of the present invention there are provided toner compositions useful for the development of electrostatic latent images including color images, and digital images.

In yet another feature of the present invention there are provided toner compositions with improved flow characteristics, and which toners enable developed images of excellent quality.

In yet a further feature of the present invention there are provided humidity insensitive, from about, for example, 20 to 80 percent relative humidity at temperatures of from 60 to 80° F. as determined in a relative humidity testing chamber, toner compositions with desirable admix properties of 5 seconds to 60 seconds as determined by the charge spectrograph, and preferably less than 15 seconds for example, and more preferably from about 1 to about 14 seconds, and acceptable triboelectric charging characteristics of from about 10 to about 40 microcoulombs per gram.

Another feature of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

The toner compositions of the present invention in embodiments thereof are comprised of resin particles, colorants, such as pigments, dyes, or mixtures thereof, and preferably pigment particles, and known toner additives, such as charge additives, surface additives of for example, silicas, and the like. More specifically, the present invention in embodiments is directed to toner compositions comprised of first toner particles with high wax content, and second toner particles free of wax, and wherein each toner contains resin, and colorant. In embodiments the second toner particles are comprised of resin, especially a reactive extruded polyester, and which particles are present in a substantial number, thereby for example, reducing wax-wax contacts. The first wax toner contains, for example, from about 8 to about 30 weight percent of wax, and preferably from about 8 to about 21 weight percent of wax, and which toner is mixed with the toner free from wax by blending, and wherein the first toner is selected in various effective amounts, for example from about 20 to about 70, and preferably from about 30 weight percent, with from about 30 to about 80, and preferably about 70 weight percent of the toner free of wax, and which toner may also include a compatibilizer, such as Kraton, reference U.S. Pat. No. 5,229,242, the disclosure of which is totally incorporated herein by reference, and wherein the resulting toner possesses a number of advantages, including increased flow characteristics.

The toner of the present invention can be comprised of a first toner with a reactive extruded polyester resin, wax, for example about 20 weight percent of polypropylene, like 660P available from Sanyo Chemicals of Japan, and colorant, like a pigment, such as carbon black, in an amount for example of about 8 weight percent, and a second toner with a reactive extruded polyester, and which toner is free from wax, and colorant. By blending the two toners there can be provided a single resulting toner with different wax levels, depending for example on the blending conditions, such as blending time and blending speed, and wherein the wax is present in the final single toner in amounts of about 2 weight percent for an about 10/90 mixture of first wax toner and second toner free of wax; about 4 weight percent wax for a 20/80 mixture, and about 6 weight percent wax for a 30/70 mixture. The percent of wax present, especially a low molecular weight wax, such as a wax with a molecular weight Mw of from about 1,000 to about 20,000, or from about 1,000 to about 10,000, like polypropylene wax 660P available from Sanyo Kasei Kogyo, is determined by differential scanning calorimetry. In this method, the enthalpy difference ($\Delta H$) of the toner is measured on heating between 116 and 154 C. which is then compared to the $\Delta H$ measured for pure 660P wax to determine to actual wax content of the toner.

In embodiments of the present invention, there was prepared in an extrusion device, available as ZSK-40 from Werner Pfleiderer, component A of the resulting toner composition by adding to the device 95 percent by weight of a crosslinked polyester resin (bisphenol-A propylene oxide fumarate polymer, with about 33 to about 40 percent gel and 5 percent by weight of Regal 330® carbon black. The resulting product was then extruded at a rate of 200 pounds per hour, reaching a melt temperature of about 175° C. The melt product exiting from the extruder was cooled to about 25° C. on a belt and then crushed into small particles. The resulting toner was subjected to grinding on an AFG micronizer, model 200AFG, enabling toner particles with a volume median diameter of from about 9 to about 13 microns as measured by a Coulter Counter. Thereafter, the aforementioned toner particles were classified in a Donaldson Model B classifier for the purpose of removing fines particles, that is, those with a volume median diameter of less than about four microns.

There was also prepared in a Banbury mixing device component B of the resulting toner composition by adding to the device 72 percent by weight of a crosslinked polyester resin (bisphenol-A propylene oxide fumarate polymer, with about 33 to about 40 percent gel, 20 weight percent of 660P Sanyo polypropylene wax, and 8 percent by weight of Regal 330® carbon black. The product resulting was processed at a rotor speed of 77 RPM and a pressure of 20 psi, at a temperature of between 178° F. and 190° F., with 3 pounds of this toner being produced after a total mix time of 5 minutes. The melt product was then cooled to about 25° C. and then crushed into small particles. The resulting toner was subjected to grinding on an 15" Sturtevant micronizer enabling toner particles with a volume median diameter of from about 9 to about 13 microns as measured by a Coulter Counter. Thereafter, the aforementioned toner particles were classified in a Donaldson Model A classifier for the purpose of removing fines particles, that is, those with a volume median diameter of less than about four microns. Differential scanning colorimentry confirmed a wax level in the toner of 18.9 percent by weight, near the 20 percent input level.

Toner compositions were prepared from the above two toner components by combining first toner component A and second toner component B in a vertical Henschel blender with a 50 liter capacity and running the blender with only the plows engaged for about 1 minute to homogenize the particles and to generate a macroscopically uniform toner with an average 660P wax content of about 6 percent by weight, in which about 60 percent by weight of the toner particles contain wax and the remaining about 40 percent by weight are wax-free. Differential scanning calorimetry confirmed that the wax content of the toner was approximately 6 percent by weight. After the toner was homogenized, an external additives package of for example: 0.6 percent by weight of a surface-treated silica with an 8 nanometer particle size (TS-530 from Cabosil Corp., with a surface-treatment of hexamethyidisilazane), 0.8 percent by weight of a surface-treated titania with a 16 nanometer particle size (MT-3103 from Tayca Corp., with a surface treatment of decylsilane), 1.0 percent by weight of untreated titania with a 25 nanometer particle size (P-25 from Degussa Chemicals), and 0.2 percent by weight of the film forming additive zinc stearate (Obtained from Synpro Inc.) was blended onto the toner in the banbury blender, using a blend time of two minutes.

The wax content of the final resulting toner can be adjusted by adjusting the relative amounts toner components A and B during the blending process, examples of which are provided in the table below.

| Weight percent toner component A | Weight percent toner component B | Theoretical wax content | Measured wax content (DSC) | Percent toner particles containing wax |
|---|---|---|---|---|
| 70 | 30 | 6 | 5.3 | 30 |
| 80 | 20 | 4 | 3.6 | 20 |
| 90 | 10 | 2 | 1.8 | 10 |

Toner flow performance can be quantified using a Hosokawa Powders Tester, available from Micron Powders Systems, using a technique that measures the toner cohesivity. The cohesion is a quantifiable measure of the flow characteristics of a given material. The higher the cohesion value, the lesser the flowability of the toner. The maximum cohesion value is 100, the minimum (no flow) approaches zero.

Using this instrument, the toners prepared according to the present invention evidenced in embodiments a measurable improvement in cohesion value and thus flow. More specifically, the measured cohesion values for a number of toners are illustrated in the table that follows, and are compared with toners of the same composition in which the wax is uniformly distributed in all of the toner particles.

| Weight percent toner component A | Weight percent toner component B | Theoretical wax content | % cohesion | % cohesion of uniform wax toner |
|---|---|---|---|---|
| 70 | 30 | 6 | 11 | 23 |
| 80 | 20 | 4 | 9.8 | 12 |
| 90 | 10 | 2 | 8.0 | 9.8 |

The toner compositions of the present invention can be prepared by admixing and heating first and second toner particles, each with resins, especially thermoplastic resins such as styrene polymers, polyesters, and similar thermoplastic resins, colorant, wax, especially low molecular weight waxes, and charge enhancing additives, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median, or volume average diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, surface additives, such as TS-720® silica are added by the blending thereof with the toner obtained.

Illustrative examples of suitable binders, or toner resins, especially thermoplastic resins, include polyamides, polyolefins, styrene acrylates, such as PSB-2700 obtained from Hercules-Sanyo Inc., and preferably selected in the amount of about 57 percent, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers, may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Waxes with a molecular weight of from about 1,000 to about 20,000, such as polyethylene, polypropylene, and paraffin waxes, are selected for the first toner and which waxes function primarily as fuser roll release agents. The resin is present in each toner in a sufficient, but effective suitable amount, for example from about 60 to about 95, and preferably from about 72 to about 95 weight percent.

Examples of colorants, include dyes, pigments, mixtures thereof, and the like, and especially pigments. Colorant examples include carbon blacks, such as Regal 330R, cyan, magenta, yellow, red, green, brown mixtures thereof, and the like, reference for example U.S. Pat. Nos. 5,554,471, 5,556,727, 5,591,552, 5,607,804 and 5,304,449, U.S. Pat. No. 5,672,457, the disclosure of which are totally incorporated herein by reference. The colorants can be selected in various effective amounts, for example from about 1 to about 20, and preferably from about 2 to about 12 weight percent. Moreover, other suitable know colorants, especially pigments not specifically recited herein may be selected.

Examples of compatibilizers that may optionally be included in the toner, preferably at a weight percentage equal to or less than that of the wax content of the toner, to primarily retain the wax therein include block or graft copolymers of the formulas A-(block)-B, A-b-B-b-A or A-(graft)-B with the polymeric segments A and B each being compatible with a different polymer thereby permitting the compatibilizer to serve, for example, as a macromolecular surfactant. Examples of compatibilizers include block copolymers, such as the KRATON® copolymers, available from Shell Chemical Company, STEREON® copolymers, available from Firestone Tire and Rubber Company, and preferably AX8840, available from Elf AtoChem, a block copolymer of ethylene-diglycidyl methacrylate. For example, KRATON G1701X®, a block copolymer of styrene-ethylene/propylene, KRATON G1726X®, a block copolymer of styrene-ethylene/butylene-styrene, KRATON G1652®, a block copolymer of styrene-ethylene/butylene-styrene, STEREON 730A®, a block copolymer of styrene and butadiene, and the like are suitable for improving the wax dispersion in styrenic resins. With KRATON G1701X®, the A segment could be the styrene block and the B segment could be an ethylene/propylene block. In embodiments of U.S. Pat. No. 5,229,242, there are provided toners wherein the compatibilizer is of the formulas A-b-B, A-b-B or A-g-B wherein A-b-B is a block copolymer of 2 segments, A and B, A-b-B-b-A is a block copolymer of 3-segments, A, B and A, and A-g-B is a graft copolymer of segments A and B, wherein the polymeric segment A is identical or compatible to one of the components present in the toner composition, that is the toner resin, whereas the polymeric segment B is identical or compatible with the other polymer component in the toner composition, that is, for example, the wax. Thus, the aforementioned compatibilizer can be comprised of rigid units, such as styrene, with the polymeric segment B being comprised of flexible, rubber-like units, such as ethylene/propylene. The molecular weight of polymeric segment A can be from about 3,000 to about 100,000, and the molecular weight of polymeric segment B can be from about 5,000 to about 200,000. The compatibilizer is present in various effective amounts, such as, for example, from about 0.5 to about 9 percent, and preferably from about 1 to about 5 weight percent in embodiments.

There can also be blended with the toner compositions of the present invention external surface additive particles including flow aid additives, which additives are usually present on the surface thereof. Examples of these additives include colloidal silicas such as Aerosil, metal salts and metal salts of fatty acids inclusive of zinc stearate, metal oxides such as aluminum oxides, cerium oxides, titanium dioxides (titania), and mixtures thereof, and wherein the total amount of the additives selected are for example, from about 0.1 percent by weight to about 5 percent by weight, and preferably from about 0.1 percent by weight to about 1 percent by weight. Several of the aforementioned additives are illustrated in U.S. Pat. Nos. 3,590,000 and 3,900,588, the disclosures of which are totally incorporated herein by reference. In embodiments each of the additives can be selected in an amount of form about 0.1 to about 5 weight percent.

Developers can be generated by the mixing of carrier with the toner, for example, from about 2 to about 5 parts of toner per about 100 parts of carrier. Known suitable carriers that may be selected include those recited in the patents mentioned herein, such as uncoated carriers of steel, iron, ferrites, and the like, and coated carriers, with coatings of fluorocarbons, polymers such as methacrylates, acrylates, and the like. Specific examples of carriers that may be selected are illustrated in U.S. Pat. Nos. 4,937,166 and 4,935,326, the disclosures of which are totally incorporated herein by reference. Preferred carriers include irregular steel powders, with volume median diameters of between about 60 and about 120 microns, coated with for example, between about 0.7 and about 1.5 percent by weight of a conductive component, and more specifically a carbon black loaded poly(methylmethacrylate) polymer.

There can be included in the toner compositions of the present invention charge additives as indicated herein in various effective amounts, such as from about 1 to about 19, and preferably from about 1 to about 3 weight percent, and in the first toner waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K. K., and the like. The commercially available polyethylenes selected have a molecular weight of from about 1,000 to about 1,500, while the commercially available polypropylenes utilized are believed to have a molecular weight of from about 4,000 to about 7,000. Many of the polyethylene and polypropylene compositions useful in the present invention are illustrated in the U.S. Patents mentioned herein, and in British Patent No. 1,442,835, the disclosure of which is totally incorporated herein by reference. The wax is present in the final toner composition of the present invention in various amounts, however, generally these waxes are present in the toner composition in an amount of from about 1 percent by weight to about 15 percent by weight, and preferably in an amount of from about 2 percent by weight to about 10 percent by weight, (average wax content for the overall toner). The toners of the present invention may also in embodiments thereof contain polymeric alcohols, such as UNILINS®, reference U.S. Pat. No. 4,883,736, the disclosure of which is totally incorporated herein by reference, and which UNILINS® are available from Petrolite Corporation.

The processes of the present invention are as illustrated herein and comprise the admixing of the toner components with heating, followed by cooling, and classification. With these processes, there are enabled toners with excellent and improved flow characteristics. Moreover, the toners of the present invention can be selected for xerographic imaging and printing systems, such as the Xerox Corporation 4213, and wherein there are enabled excellent quality images with substantially no background deposits, and the toner possesses improved flow characteristics. Improved toner flow prevents magnetic roll starvation and, therefore, the white streaking print defect. White streaking, or areas of nonprinting usually occurs when there is no toner on the magnetic roll to transfer to the photoreceptor. When the toner flows well, it flows readily and substantially completely, that is about 95 to 100 percent of the toner, to the magnetic roll. Flow in SCD (single component development) toners is important since there is no carrier to assist in movement of the toner to the roll, and also is of importance for two component developers comprised of toner and carrier.

Aspects of the present invention include:

- a toner composition comprised of a mixture of first toner with wax, and second toner free of wax, and wherein said first and said second toner contain binder, and said first toner with wax contains colorant;
- a toner composition generated from a mixture of first toner with wax, and second toner free of wax, and wherein said first and said second toner contain resin, and colorant;
- a toner wherein the resin is a polyester;
- a toner wherein the resin is a reactive extruded polyester, and wherein the gel content thereof is from about 5 to about 40 percent by weight of the resin;
- a toner wherein the polyester resin is bisphenol-A propylene oxide fumarate polymer;
- a toner wherein the first toner is selected in an amount of from about 20 to about 70 weight percent, and the second toner is selected in an amount of from about 30 to about 80 weight percent, and wherein the total of amount of said fist toner and said second toner in said resulting toner is about 100 percent;

a toner wherein the first toner is selected in an amount of about 60 weight percent, and the second toner is selected in an amount of 40 weight percent;

a toner wherein the wax content of the resulting toner is from about 2 to about 12 weight percent;

a toner wherein the wax content of the resulting toner is from about 3 to about 8 weight percent;

a toner wherein the toner further includes a compatibilzer present in an amount of form about 2 to about 10 weight percent;

a toner wherein the colorant is a pigment;

a toner wherein the binder is a thermoplastic resin of a styrene acrylate, a styrene methacrylate, or a polyester;

a toner with a toner cohesion value of from about 5 to about 10 percent;

a toner wherein the colorant is the pigment carbon black;

a toner wherein the colorant is cyan, magenta, yellow, red, or mixtures thereof;

a toner wherein the colorant is present in an amount of from about 2 to about 10 weight percent;

a toner wherein the toner cohesion flow value of said resulting toner is from about 5 to about 10 percent as measured with a Hosokawa Powders Tester;

a toner further containing a charge additive present in an amount of from about 0.05 to about 5 weight percent, or present in an amount of from about 0.1 to about 3 weight percent.

a toner with a toner admix time of less than about, or equal to about 15 seconds, or an admix time of from about 1 to about 14 seconds, and with triboelectric charge of from about 10 to about 40 microcoulombs per gram;

a toner wherein said wax possesses a low molecular weight, Mw of from about 1,000 to about 20,000 and wherein said wax is optionally selected from the group consisting of polyethylene and polypropylene;

a toner wherein the charge additive is[1-[(3,5-disubstituted-2-hydroxyphenyl)azo]-3-(mono-substituted)-2-naphthalenolato (2-)]chromate (1-), ammonium sodium and hydrogen (TRH), Aizon Spilon;

a process for the preparation of toner which comprises admixing a composition generated from a mixture of first toner with wax, and second toner free of wax, and wherein said first and said second toner contain resin, and colorant, and wherein said toner optionally contains a compatabilizer;

a process in accordance with claim 22 wherein the resulting toner composition generated from the mixture of said first toner with wax, and second toner free of wax are combined in a low intensity mixing Henschel blender device wherein the first toner is selected in an amount of from about 20 to about 70 weight percent, and the second toner is selected in an amount of from about 30 to about 80 weight percent, and subsequently external additives are blended onto the surface of the toner, and wherein said toner possesses enhanced flowability; and a toner composition comprised of a first toner with wax, and second toner free of wax, and wherein said first toner and said second toner each contain resin, and colorant.

The following Examples are provided.

EXAMPLE I

5 There was prepared in an extrusion device, available as ZSK-40 from Werner Pfleiderer, first component A of the toner composition by adding to the extrusion device 95 percent by weight of a crosslinked polyester resin (bisphenol-A propylene oxide fumarate polymer, with about 33 to 40 percent gel and 5 percent by weight of Regal 330® carbon black pigment. The product was then extruded at a rate of 200 pounds per hour, reaching a melt temperature of about 175° C. The melt product exiting from the extruder was cooled to about 25° C. on a belt and then crushed into small particles. The resulting toner was subjected to grinding on an AFG micronizer, model 200AFG, enabling toner particles with a volume median diameter of 9 to 13 microns as measured by a Coulter Counter. Thereafter, the aforementioned toner particles were classified in a Donaldson Model B classifier for the purpose of removing fines particles, that is, those with a volume median diameter of less than about, or equal to about four microns.

There was also prepared in a Banbury mixing device second component B of the toner composition by adding thereto 82 percent by weight of a crosslinked polyester resin (bisphenol-A propylene oxide fumarate polymer, with 33–40 percent gel), 10 percent of 660P Sanyo polypropylene wax, and 8 percent by weight of Regal 330® carbon black. The product was processed at a rotor speed of 77 RPM and a pressure of 20 psi, at a temperature of between 178® F. and 190° F., with 30 pounds produced in a total mix time of 5 minutes. The melt product was cooled to about 25° C. and then crushed into small particles. The resulting toner was subjected to grinding on an 15" Sturtevant micronizer enabling toner particles with a volume median diameter of from 9 to 13 microns as measured by a Coulter Counter. Thereafter, the aforementioned toner particles were classified in a Donaldson Model A classifier for the purpose of removing fines particles, that is, those with a volume median diameter of less than about or equal to about four microns.

A final toner composition was prepared from the above two first and second components by combining 1.82 kg of toner component A and 2.73 kg of toner component B in a vertical Henschel blender with a 50 liter capacity and running the blender with only the plows engaged for 1 minute to homogenize the particles and to generate a macroscopically uniform toner with an average 660P wax content of 6 percent by weight, in which 60 percent by weight of the toner particles containing the wax and the remaining 40 percent by weight are wax-free. Differential scanning calorimetry confirmed that the wax content of the toner was approximately 6 percent by weight. After the toner was homogenized, an external additives package of: 0.6 percent by weight of a surface-treated silica with an 8 nanometer particle size (TS-530 from Cabosil Corp., with a surface treatment of hexamethyidisilazane), 0.8 percent by weight of a surface-treated titania with a 16 nanometer particle size (MT-3103 from Tayca Corp., with a surface treatment of decylsilane), 1.0 percent by weight of untreated titania with a 25 nanometer particle size (P-25 from Degussa Chemicals), and 0.2 percent by weight of the film forming additive zinc stearate (Obtained from Synpro Inc.) was blended onto the toner in the blender, using a blend time of two minutes.

Toner flow performance was quantified using a Hosokawa Powders Tester, available from Micron Powders Systems, using a technique that measures the toner cohesivity. The cohesion is a quantifiable measure of the flow characteristics of a given material. The higher the cohesion value, the lesser the flowability of the toner. The maximum cohesion value is 100, the minimum (no flow) approaches zero.

Using this instrument, the above prepared final toner evidenced a measurable improvement in cohesion value and thus flow, with respect to a toner prepared with the same composition as above except that the 6 percent wax by weight was uniformly distributed throughout all of the toner particles, and more specifically, the measured cohesion value was about 8 for the toner in this example and about 12 for the toner with uniformly distributed wax. More importantly, the cohesion value of the final toner after it has been aged in a xerographic environment for 20 minutes in a nonthroughout mode, that is with no toner dispensed into the xerographic development system and no printed images made, is about 50, which is significantly less than the value obtained for a toner with the wax uniformly distributed in the toner, which is about 70. A cohesion value of less than 65 is of importance for functional development in a xerographic environment. Aging in a xerographic environment, such as the Xerox Corporation 5090 for 20 minutes in a nonthroughout mode is equivalent to aging a toner for greater than 100,000 copies with an average print area coverage of about 2 percent of a page, which is required of a xerographic development system.

The triboelectric value of the final prepared toner was measured against a carrier of an irregular steel core coated with 1 percent by weight of a carbon black loaded polymethylmethacrylate polymer. After mixing the toner and carrier at a toner concentration of 4 percent by weight for 10 minutes in a standard mixing device, the triboelectric charge imparted to the toner was measured to be 10.3 microcoulombs per gram. This value is equivalent to the tribelectric value of a toner of the same composition except that the wax is uniformly distributed on all of the toner particles, and which toner had a triboelectric value of 10.7 microcoulombs per gram.

The admix properties of the final toner were also tested using the standard toner admix test, wherein the toner was mixed with the above specified carrier at a toner concentration of 2 percent by weight for a period of 5 minutes, after which an additional 1 percent by weight of toner is added to the developer. Thereafter, the developer containing both mixed and fresh toner is further mixed, for a period of 1 minute, with the charge distribution measured every 15 seconds using a standard charge spectrograph device. The toner shows rapid admix, with no significant wrong sign or low charge toner at 15 seconds of mixing. This admix performance is equivalent to that of a toner of the same composition except that the wax is uniformly distributed on all of the toner particles, and which toner also has an admix time of less than 15 seconds.

The fusing properties of the above prepared final toner was measured using a standard Xerox 5350 fusing subsystem, in which the toner was first charged against a carrier of an irregular steel core coated with 1 percent by weight of polyvinylidene flouride to enable the proper developer triboelectric characteristics. The toner was then developed onto a layered organic photoconductor, reference U.S. Pat. No. 4,265,990, the disclosure of which is totally incorporated herein by reference, and transferred to paper with a transferred mass of between 0.75 and 0.84 mg per square centimeter. The minimum fix temperature to enable a toner crease value of 40 is measured to be 368 F. and the hot offset temperature is greater than about 450 F. These values are comparable to the fusing characteristics of a wax containing toner with 86.7 percent by weight of a styrene/n-butyl acrylate copolymer PSB2733SS obtained from Sanyo Chemical, 6 percent by weight Regal 330 carbon black, 6 percent by weight P200 polypropylene wax obtained from Mitsui Sekiyu Chemical, 0.5 percent by weight of 800P polyethylene wax obtained from Mitsui Sekiyu Chemical, and 0.8 percent by weight Bontron P51 charge control agent obtained from Orient Chemical (benyltributylammonium 4-hydroxy-1-naphthalenesulfonate.

The above final invention toner fusing values are also equal to or superior to the fusing characteristics of a toner with the same formulation except that the wax was uniformly distributed in all of the toner particles, and which toner had a minimum fix temperature of 386 F. temperature to enable a toner crease value of 40 and a hot offset temperature of greater than 450 F. Both of these toners have fusing characteristics which are superior to those of toners which do not contain wax, which show a failure in the fusing subsystem due to an inability of the paper containing the toner to separate from the fuser roll.

EXAMPLE II

There was prepared in an extrusion device, available as ZSK-40 from Werner Pfleiderer, component A of a toner composition by adding to the device 95 percent by weight of a crosslinked polyester resin (bisphenol-A propylene oxide fumarate polymer, with about 33 to 40 percent gel and 5 percent by weight of Regal 330® carbon black. The resulting product was then extruded at a rate of 200 pounds per hour, at a final melt temperature of about 175° C. The melt product exiting from the extruder was cooled to about 25° C. on a belt and then crushed into small particles. The resulting toner was subjected to grinding on an AFG micronizer, model 200AFG, enabling toner particles with a volume median diameter of from 9 to 13 microns as measured by a Coulter Counter. Thereafter, the aforementioned toner particles were classified in a Donaldson Model B classifier for the purpose of removing fines particles, that is, those with a volume median diameter of less than about 4.0 microns.

There was also prepared in a Banbury mixing device component B of the toner composition by adding to the device 72 percent by weight of a crosslinked polyester resin (bisphenol-A propylene oxide fumarate polymer, with about 33–40 percent gel), 20 percent of 660P Sanyo polypropylene wax, and 8 percent by weight of Regal 330® carbon black. The product was processed at a rotor speed of 77 RPM and a pressure of 20 psi, at a temperature of between 185° F. and 192° F., with 30 lbs. produced in a total mix time of 5 minutes. The melt product was cooled to about 25° C. and then crushed into small particles. The resulting toner was subjected to grinding on an 15" Sturtevant micronizer enabling toner particles with a volume median diameter of from 9 to 13 microns as measured by a Coulter Counter. Thereafter, the aforementioned toner particles were classified in a Donaldson Model A classifier for the purpose of removing fines particles, that is, those with a volume median diameter of less than about four microns.

A toner composition was prepared from the above two components by combining 3.18 kg of toner component A and 1.36 kg of toner component B in a vertical Henschel blender with a 50 liter capacity and running the blender with only the plows engaged for 1 minute to homogenize the particles to produce a macroscopically uniform toner with an average 660P wax content of 6 percent by weight, and wherein 30 percent by weight of the toner particles contain the wax and the remaining 70 percent by weight are wax-free. Differential scanning calorimetry confirmed that the wax content of the toner was approximately 6 percent by weight. After the toner was homogenized, an external additives package of: 0.6 percent by weight of a surface-treated silica with an 8 nanometer particle size (TS-530 from Cabosil Corp., with a surface treatment of hexamethyidisilazane), 0.8 percent by weight of a surface-treated titania with a 16 nanometer particle size (MT-3103 from Tayca Corp., with a surface treatment, or coating of decylsilane), 1.0 percent by weight of untreated titania with a 25 nanometer particle size (P-25 from Degussa Chemicals), and 0.2 percent by weight of the film forming additive zinc stearate (Obtained from Synpro Inc.) was blended onto the toner in the above blender, using a blend time of two minutes.

Toner flow performance was quantified using a Hosokawa Powders Tester, available from Micron Powders Systems, and using a technique that measures the toner cohesivity. The cohesion is a quantifiable measure of the flow characteristics of a given material. The higher the cohesion value, the lesser the flowability of the toner. The maximum cohesion value is 100, the minimum (no flow) approaches zero.

Using this instrument, the above prepared toner evidenced a measurable improvement in cohesion value and thus flow, with respect to a toner prepared with the same composition as above except that the 6 percent wax by weight was uniformly distributed throughout all of the toner particles, and more specifically, the measured cohesion value of the final invention toner was about 10 and about 12 for the toner with uniformly distributed wax. More importantly, the cohesion value of the toner after it has been aged in a xerographic environment for 20 minutes in a nonthroughout mode, that is with no toner dispensed into the xerographic development system and no printed images made, is about 60, which is less than the value obtained for a toner with the wax uniformly distributed in the toner, which is about 70. A cohesion value of less than 65 is important for functional development in a xerographic environment, and aging in a xerographic environment for 20 minutes in a nonthroughout mode is equivalent to aging a toner for greater than 100,000 copies with an average print area coverage of about 2 percent of a page, which is required of a xerographic development system.

The triboelectric value of the final toner was measured against a carrier of an irregular steel core coated with 1 percent by weight of a carbon black loaded polymethylmethacrylate polymer. After mixing the toner and carrier at a toner concentration of 4 percent by weight for 10 minutes in a standard mixing device, the triboelectric charge imparted to the toner was measured to be 10.5 microcoulombs per gram. This value is equivalent to the tribelectric value of a similar toner except that the wax is uniformly distributed all of the toner particles and this toner had a triboelectric value of 10.7 microcoulombs per gram. The admix properties of this toner were also tested using the standard toner admix test, in which a toner is mixed with the above specified carrier at a toner concentration of 2 percent by weight for a period of 5 minutes, after which an additional 1 percent by weight of toner is added to the developer. Thereafter, the developer containing both mixed and fresh toner is further mixed, for a period of 1 minute, with the charge distribution measured every 15 seconds using a standard charge spectrograph device. The toner shows rapid admix, with no significant wrong sign or low charge toner at 15 seconds of mixing. This admix performance is equivalent to that of a toner of the same composition except that the wax is uniformly distributed all of the toner particles, and which equivalent admix time is less than 15 seconds.

The fusing properties of the above final invention toner was measured using a standard Xerox 5350 fusing subsystem, in which the toners were first charged against carriers of an irregular steel core coated with 1 percent by weight of polyvinylidene flouride to enable the proper developer triboelectric characteristics. The toner was then developed onto a photoreceptor and transferred to paper with a transferred mass of between 0.75 and 0.86 mg per square centimeter. The minimum fix temperature to enable a toner was greater than 450 F. These values are comparable to the fusing characteristics of a Xerox Corporation 5350 toner, and equal to or superior than the fusing characteristics of a toner with the above same final invention formulation except that the wax was uniformly distributed on all of the toner particles, and which similar toner had a minimum fix temperature of 386 F. temperature to enable a toner crease value of 40 and a hot offset temperature of greater than 450 F. Both of these toners have fusing characteristics which are superior to those of toners which do not contain wax, which toners without wax show a failure in the fusing subsystem due to an inability of the paper containing the toner to separate from the fuser roll.

EXAMPLE III

A toner composition was prepared from the two components of Example II by combining 3.64 kg of toner component A and 0.91 kg of toner component B in a vertical Henschel blender with a 50 liter capacity and operating the blender with only the plows engaged for 1 minute to homogenize the particles and to generate a macroscopically uniform toner with an average 660P wax content of 4 percent by weight, in which 20 percent by weight of the toner particles contain the wax and the remaining 80 percent by weight are wax-free. Differential scanning calorimetry confirmed that the wax content of the toner was approximately 4 percent by weight. After the toner was homogenized, an external additives package of: 0.6 percent by weight of a surface-treated silica with an 8 nanometer particle size (TS-530 from Cabosil Corp., with a surface treatment of hexamethyldisilazane), 0.8 percent by weight of a surface-treated titania with a 16 nanometer particle size (MT-3103 from Tayca Corp., with a surface treatment of decylsilane), 1.0 percent by weight of untreated titania with a 25 nanometer particle size (P-25 from Degussa Chemicals), and 0.2 percent by weight of the film forming additive zinc stearate (Obtained from Synpro Inc.) was blended onto the toner with a blend time of two minutes.

Toner flow performance was quantified using a Hosokawa Powders Tester, available from Micron Powders Systems, using a technique that measures the toner cohesivity. The cohesion is a quantifiable measure of the flow characteristics of a given material. The higher the cohesion value, the lesser the flowability of the toner. The maximum cohesion value is 100, the minimum (no flow) approaches zero.

Using this instrument, the above prepared final toner evidenced a measurable improvement in cohesion value and thus flow, with respect to a toner prepared with the same composition except that the 6 percent wax by weight was uniformly distributed throughout all of the toner particles, and more specifically, the measured cohesion value was about 10 for the invention final toner and about 7 for the toner with uniformly distributed wax. More importantly, the cohesion value of the final toner after it has been aged (operated) in a xerographic environment for 20 minutes in a nonthroughout mode, that is with no toner dispensed into the xerographic development system and no printed images made was about 54.

The triboelectric value of the final toner was measured against a carrier of an irregular steel core coated with 1 percent by weight of a carbon black loaded polymethylmethacrylate polymer. After mixing the toner and carrier at a toner concentration of 4 percent by weight for 10 minutes in a standard mixing device, the triboelectric charge imparted to the toner was measured to be 9.5 microcoulombs per gram.

EXAMPLE IV

There was prepared in an extrusion device, available as ZSK-40 from Werner Pfleiderer, component A of the toner composition by adding to the device 95 percent by weight of a crosslinked polyester resin (bisphenol-A propylene oxide fumarate polymer, with about 33 to 40 percent gel and 5 percent by weight of Regal 330® carbon black. The resulting product was then extruded at a rate of 200 pounds per hour and the final melt temperature was about 175° C. The melt product exiting from the extruder was cooled to about 25° C. on a belt and then crushed into small particles. The resulting toner was subjected to grinding on an AFG micronizer, model 200AFG, enabling toner particles with a volume median diameter of from 9 to 13 microns as measured by a Coulter Counter. Thereafter, the aforementioned toner particles were classified in a Donaldson Model B classifier for the purpose of removing fines particles, that is, those with a volume median diameter of less than about 4.0 microns.

There was also prepared in a Banbury mixing device component B of the toner composition by adding thereto 72 percent by weight of a crosslinked polyester resin (bisphenol-A propylene oxide fumarate polymer, with about 33 to 40 percent gel, 20 percent of 660P Sanyo polypropylene wax, and 8 percent by weight of Regal 330® carbon black. The product was processed at a rotor speed of 77 RPM and a pressure of 20 psi, at a temperature of between 185® F. and 192° F., with 25 lbs. produced in a total mix time of 5 minutes. The melt product was cooled to about 25° C. and then crushed into small particles. The resulting toner was subjected to grinding on an 15" Sturtevant micronizer enabling toner particles with a volume median diameter of from 9 to 13 microns as measured by a Coulter Counter. Thereafter, the aforementioned toner particles were classified in a Donaldson Model A classifier for the purpose of removing fines particles, that is, those with a volume median diameter of less than about four microns.

A toner composition was prepared from the above two components by combining 240 g of toner component A and 60 g of toner component B in a Waring blender, with 10 blending cycles, each 10 seconds in duration. This resulted in a toner with an average wax content of 4 percent by weight. The toner was then blended in a low intensity Labmaster blender with an external additives package of: 0.4 percent by weight of a surface-treated silica with an 8 nanometer particle size (TS-530 from Cabosil Corp., with a surface treatment of hexamethyidisilazane), 1.1 percent by weight of a surface-treated titania with a 16 nanometer particle size (MT-3103 from Tayca Corp., with a surface treatment of decylsilane), and 0.2 percent by weight of the film forming additive zinc stearate (Obtained from Synpro Inc.).

Using A Hosakowa Powder Tester, the above prepared toner evidenced a measurable improvement in cohesion value and thus flow, with respect to a toner prepared with the same composition as above except that the 4 percent wax by weight was uniformly distributed throughout all of the toner particles. More specifically, the cohesion value of the toner after it has been aged in a xerographic environment for 20 minutes in a nonthroughout mode, that is with no toner dispensed into the xerographic development system and no printed images made, was about 69, which is less than the value obtained for a toner with the wax uniformly distributed in the toner, which is about 84.

The triboelectric value of the final toner was measured against a carrier of an irregular steel core coated with 1 percent by weight of a carbon black loaded polymethylmethacrylate polymer. After mixing the toner and carrier at a toner concentration of 4 percent by weight for 10 minutes in a standard mixing device, the triboelectric charge imparted to the toner was measured to be 17.6 microcoulombs per gram. This value is nearly equivalent to the tribelectric value of a toner with the same composition except that the wax was uniformly distributed all of the toner particles, and which toner had a triboelectric value of 19.9 microcoulombs per gram.

EXAMPLE V

A toner composition was prepared from the two components of Example IV by combining 210 g of toner component A and 90 g of toner component B in a Waring blender, with 10 blending cycles, each 10 s in duration, carried out at low intensity. This resulted in a toner with an average wax content of 6 percent by weight, in which toner particles with wax constituted 30 percent of the total toner particles and in which the wax containing and non-wax containing particles were well dispersed. The toner was then blended in a low intensity Labmaster blender with an external additives package of: 0.4 percent by weight of a surface-treated silica with an 8 nanometer particle size (TS-530 from Cabosil Corp., with a surface treatment of hexamethyldisilazane), 1.1 percent by weight of a surface-treated titania with a 16 nanometer particle size (MT-3103 from Tayca Corp., with a surface treatment of decylsilane), and 0.2 percent by weight of the film forming additive zinc stearate (Obtained from Synpro Inc.).

Using A Hosakowa Powder Tester, the above prepared toner evidenced a measurable improvement in cohesion value and thus flow, with respect to a toner prepared with the same composition as above except that the 4 percent wax by weight was uniformly distributed throughout all of the toner particles. More specifically, the cohesion value of the final toner after it has been aged in a xerographic environment for 20 minutes in a nonthroughout mode, that is with no toner dispensed into the xerographic development system and no printed images made, was about 69, which is less than the value obtained for a toner with the wax uniformly distributed in the toner, which is about 93.

The triboelectric value of the final toner was measured against a carrier of an irregular steel core coated with 1 percent by weight of a carbon black loaded polymethylmethacrylate polymer. After mixing the toner and carrier at a toner concentration of 4 percent by weight for 10 minutes in a standard mixing device, the triboelectric charge imparted to the toner was measured to be 16.4 microcoulombs per gram. This value is nearly equivalent to the tribelectric value of a toner with the same composition except that the wax was uniformly distributed all of the toner particles, and which toner had a triboelectric value of 20.7 microcoulombs per gram.

Other modifications of the present invention may occur to one of ordinary skill in the art subsequent to a review of the present application, and these modifications, including equivalents, or substantial equivalents thereof, are intended to be included within the scope of the present invention.

What is claimed is:

1. A toner composition generated from a mixture of first toner with wax, and second toner free of wax, and wherein said first toner is comprised of resin, colorant, and wax, and said second toner comprises resin, colorant, and compatibilizer.

2. A toner composition comprised of a first toner with wax, and second toner free of wax, and wherein said first toner is comprised of resin, colorant, and wax, and said second toner is comprised of resin, colorant, and compatibilizer, and wherein said wax is uniformly contained in said toner composition.

3. A toner composition consisting essentially of a mixture of first toner with wax, and second toner free of wax, and wherein said first toner consists essentially of binder, wax, and colorant, and said second toner consists essentially of colorant, binder and compatibilizer, and wherein said wax is contained in said toner.

4. A toner in accordance with claim 3 wherein there is added to said toner composition surface additives, and wherein said wax is uniformly dispersed in said toner composition.

5. A toner in accordance with claim 1 wherein the resin is a polyester.

6. A toner in accordance with claim 1 wherein the resin is a reactive extruded polyester, and wherein the gel content thereof is from about 5 to about 40 percent by weight of the resin.

7. A toner in accordance with claim 6 wherein the polyester resin is bisphenol-A propylene oxide fumarate polymer.

8. A toner in accordance with claim 1 wherein the first toner is selected in an amount of from about 20 to about 70 weight percent, and the second toner is selected in an amount of from about 30 to about 80 weight percent, and wherein the total amount of said first toner and said second toner in said resulting toner is about 100 percent.

9. A toner in accordance with claim 1 wherein the first toner is selected in an amount of about 60 weight percent, and the second toner is selected in an amount of 40 weight percent.

10. A toner in accordance with claim 1 wherein the wax content of the resulting toner is from about 2 to about 12 weight percent.

11. A toner in accordance with claim 1 wherein the wax content of the resulting toner is from about 3 to about 8 weight percent.

12. A toner in accordance with claim 1 wherein said compatibilizer present in an amount of from about 2 to about 10 weight percent.

13. A toner in accordance with claim 1 wherein the colorant is a pigment.

14. A toner in accordance with claim 1 wherein the binder is a thermoplastic resin of a styrene acrylate, a styrene methacrylate, or a polyester.

15. A toner in accordance with claim 1 with a toner cohesion value of from about 5 to about 10 percent.

16. A toner in accordance with claim 1 wherein the colorant is the pigment carbon black.

17. A toner in accordance with claim 1 wherein the colorant is cyan, magenta, yellow, red, or mixtures thereof.

18. A toner in accordance with claim 17 wherein the colorant is present in an amount of from about 2 to about 10 weight percent.

19. A toner in accordance with claim 1 wherein the toner cohesion flow value of said resulting toner is from about 5 to about 10 percent as measured with a Hosokawa Powders Tester.

20. A toner composition in accordance with claim 1 further containing a charge additive present in an amount of from about 0.05 to about 5 weight percent, or present in an amount of from about 0.1 to about 3 weight percent.

21. A toner composition in accordance with claim 1 with a toner admix time of less than about, or equal to about 15 seconds, or an admix time of from about 1 to about 14 seconds, and with triboelectric charge of from about 10 to about 40 microcoulombs per gram.

22. A toner composition in accordance with claim 1 wherein said wax possesses a low molecular weight, Mw of from about 1,000 to about 20,000 and wherein said wax is optionally selected from the group consisting of polyethylene and polypropylene.

23. A toner composition in accordance with claim 20 wherein the charge additive is [1-[(3,5-disubstituted-2-hydroxyphenyl)azo]-3-(mono-substituted)-2-naphthalenolato (2-)]chromate (1-), ammonium sodium and hydrogen (TRH), Aizon Spilon.

24. A process for the preparation of toner which comprises admixing a composition generated from a mixture of first toner with wax, toner is comprised of resin, colorant, and wax, and said second toner comprises a resin, colorant, and compatibilizer.

25. A process in accordance with claim 24 wherein the resulting toner composition generated from the mixture of said first toner with wax, and second toner free of wax are combined in a low intensity mixing Henschel blender device wherein the first toner is selected in an amount of from about 20 to about 70 weight percent, and the second toner is selected in an amount of from about 30 to about 80 weight percent, and subsequently external additives are blended onto the surface of the toner, and wherein said toner possesses enhanced flowability.

* * * * *